US006916209B1

(12) United States Patent
Casher et al.

(10) Patent No.: US 6,916,209 B1
(45) Date of Patent: Jul. 12, 2005

(54) ELECTRICAL SIGNAL TRANSMISSION SYSTEM

(75) Inventors: Patrick R. Casher, North Aurora, IL (US); Michael R. Kamarauskas, Bloomingdale, IL (US)

(73) Assignee: Molex Incorporated, Lilse, IL (US)

( * ) Notice: Subject to any disclaimer, the term of this patent is extended or adjusted under 35 U.S.C. 154(b) by 24 days.

(21) Appl. No.: 10/763,716

(22) Filed: Jan. 23, 2004

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS

| | | | | |
|---|---|---|---|---|
| 5,362,257 A | | 11/1994 | Neal et al. | 439/676 |
| 5,399,107 A | | 3/1995 | Gentry et al. | 439/676 |
| 5,586,914 A | | 12/1996 | Foster, Jr. et al. | 439/676 |
| 5,626,497 A | | 5/1997 | Bouchan et al. | 439/676 |
| 5,911,602 A | | 6/1999 | Vaden | 439/676 |
| 5,921,818 A | | 7/1999 | Larsen et al. | 439/676 |
| 6,116,964 A | * | 9/2000 | Goodrich et al. | 439/676 |
| 6,186,834 B1 | * | 2/2001 | Arnett et al. | 439/676 |
| 6,416,363 B1 | | 7/2002 | Sumiyoshi et al. | 439/676 |
| 6,558,207 B1 | * | 5/2003 | Pepe et al. | 439/862 |

* cited by examiner

*Primary Examiner*—Hae Moon Hyeon
(74) *Attorney, Agent, or Firm*—Stephen Z. Weiss

(57) ABSTRACT

An electrical signal transmission system includes a plurality of elongated conductors extending in a generally parallel array. The conductors have input ends at one end of the array and output ends at an opposite end of the array. Each conductor includes an elongated intermediate section and transition sections at opposite ends of the intermediate section joining the intermediate section to the input and output ends of the conductor. The array of conductors define two outside pairs of conductors and at least one inside pair of conductors. The elongated intermediate sections of the conductors in the inside pair thereof being spaced apart wider than the elongated intermediate sections of the conductors in each outside pair thereof.

24 Claims, 5 Drawing Sheets

ELECTRICAL SIGNAL TRANSMISSION SYSTEM

FIELD OF THE INVENTION

This invention generally relates to the art of electrical signal transmissions and, particularly, to an improved electrical signal transmission system for a plurality of elongated, generally parallel conductors where crosstalk is reduced.

BACKGROUND OF THE INVENTION

Various electrical connector devices include a plurality of elongated conductors which electrically interconnect respective inputs and outputs of the connector device. As is known, when an elongated conductor is adjacent to or relatively near another elongated conductor, crosstalk typically is experienced. Crosstalk is defined as the undesirable coupling or the transmission of an electrical signal from one circuit to another nearby circuit. Crosstalk mechanisms are inductive (magnetic field) coupling and by capacitive (electric field) coupling. The level of crosstalk is increased between conductors which are generally parallel, such as the elongated conductors of a cable, modular jacks and plugs, or a printed circuit board.

Crosstalk is undesirable because the integrity and definition of the signals transmitted by the conductors is degraded by the interfering coupled signals. Crosstalk becomes more of a problem with relatively high frequency content signals.

Modular jacks and plugs have certain terminal arrangements to provide standards for intermatability. The plug is normally terminated to a cable having a plurality of parallel conductors which may be connected to a telephone handset or other communications device. The conductors are paired and each pair forms a signal loop or differential signal. Each pair in the cable normally consists of two adjacent twisted conductors. This arrangement in the cable results in certain electrical characteristics of the cable including its characteristic impedance and propagation velocity.

Each jack includes a plurality of elongated terminals which are closely spaced and parallel to one another. A typical jack has eight adjacent and parallel terminals. These terminals are arranged in signal pairs where each pair forms a separate communication circuit. When an electrical signal with a given frequency content is applied to a pair of conductors, an unequal portion of signal energy is transmitted to the individual conductors of an adjacent pair by each conductor of the signal pair. This transmission is primarily due to the capacitive and inductive couplings between adjacent conductors resulting in crosstalk. The extent of the crosstalk is governed by such parameters as the space between the adjacent conductors, the dielectric constant of the material between such conductors, the distance in which such conductors are closely spaced and parallel to one another, and the frequency content of the signal. With modular plugs and jacks being utilized more and more in high frequency applications and with the miniaturization of the plugs and jacks resulting in a very close spacing of the terminals, crosstalk has become a greater problem.

It has been found that crosstalk can be reduced to a great extent through cancellation by the placement of conductors, or the placement of traces on a printed circuit board connecting conductors, within the jack or plug, so as to send signals of an opposite phase against those creating the crosstalk. To decrease crosstalk, the conductors or circuit traces that form both pairs should be routed in a pattern that is opposite in polarity to the pattern that produced the crosstalk. Thus, a signal creating crosstalk with a given polarity is cancelled by a signal of an opposite polarity created by the appropriately placed conductors or traces on the printed circuit board.

The crosstalk reduction techniques used in the past, which include primarily tuned capacitive coupling, have had a desirable effect on the reduction of crosstalk. However, the rerouting of the conductors or circuit traces on the circuit board to create the tuned capacitances contributes to an impedance mismatch of the entire transmission system, including the cable, connector, and circuit board, thereby negatively affecting return loss, voltage standing wave ratio, and combined system attenuation. The use of tuned capacitive coupling alone to cancel both capacitive and inductive crosstalk is inherently unstable. The present invention is directed to solving the various problems outlined above by partial cancellation of pair-to-pair interference or crosstalk created in elongated parallel conductors, while maintaining proper characteristic impedance and longitudinal balance within the electrical signal transmission system. This is accomplished by providing both capacitive and inductive coupling mechanisms in a symmetrical manner to reduce crosstalk. Impedance can be calculated by the using formula of the square root of inductance divided by capacitance. With both inductive and capacitive coupling being tuned in the subject invention, impedance can also be controlled since both the numerator and denominator of the impedance ratio can be adjusted. This is contrasted with the prior art, where primarily tuned capacitive coupling is used to control impedance. With only capacitive coupling being tuned, only the denominator in the impedance ratio can be adjusted.

Inductive coupling is increased by increasing self inductance within a signal pair and mutual inductance between signal pairs. Self inductance is increased by locating the legs of one circuit pair farther away from each other. Because the problem of crosstalk is the greatest with the two inner circuit pairs, their legs are located a distance further away from each other than the distance between the legs of the outer circuit pairs. Mutual inductance is increased when the legs of one circuit pair overlie the legs of another circuit pair. If not overlying each other, then mutual inductance is greater when the center lines of each circuit pair are closer to each other. With both mutual and self inductance increased, the total inductive coupling will be increased. Thus an important feature of this invention is the greater separation of the elongated sections of the conductors forming the inner circuit pairs which increases inductive coupling.

One of the advantages with dual tuned inductive and capacitive coupling is that space can be created between the circuits for corrective capacitive coupling which can be used to further control impedance mismatch. To further adjust the impedance of the circuit, three overlapped plates were designed which extend by way of a tab from each leg of one inner circuit pair. Although one pair of overlapping plates may be adequate, three tabs and three plates are used in the preferred embodiment because three plates are easier to manufacture and spread the capacitance over three areas which will improve the electrical characteristics at higher frequencies. The overlapped plates will create just enough additional capacitance to reduce the impedance caused by the additional inductance. This will result in an improved return loss.

SUMMARY OF THE INVENTION

An object, therefore, of the invention is to provide a new and improved electrical signal transmission system of the character described.

In the exemplary embodiment of the invention, a plurality of elongated conductors extend in a generally parallel array. The conductors have input ends at one end of the array and output ends at an opposite end of the array. Each conductor includes an elongated intermediate section, along with transition sections at opposite ends of the intermediate section joining the intermediate section to the input and output ends of the conductor. The array of conductors define two outside pairs of conductors and at least one inside pair of conductors. The transition sections of the conductors in each outside pair of conductors cross each other. The elongated intermediate sections of the conductors in the inside pair thereof are spaced apart wider than the elongated intermediate sections of the conductors in each outside pair thereof.

As disclosed herein, the generally parallel array of conductors define a center line generally equidistant from and parallel to opposite sides of the array. In the preferred embodiment, the elongated intermediate sections of the conductors in one outside pair thereof are spaced from the center line a distance equal to that of the elongated intermediate sections of the conductors in the other outside pair thereof. The elongated intermediate sections of the conductors in the inside pair thereof are spaced equidistant from opposite sides of the center line.

According to one aspect of the invention, the elongated intermediate sections of the conductors in each outside pair thereof are spaced apart a distance generally equal to the spacing between the respective input ends of the conductors in the respective outside pair thereof.

According to another aspect of the invention, a second inside pair of conductors have elongated intermediate sections spaced apart wider than the elongated intermediate sections of the conductors in each outside pair thereof. The transition sections of the conductors in the second inside pair thereof are separated from each other and are void of any crossover. According to a further aspect of the invention, an elongated intermediate section of one of the pairs of conductors substantially overlaps an elongated intermediate section of another of the pairs of conductors. A layer of non-conductive material is disposed between the overlapping elongated intermediate sections.

According to still another aspect of the invention, a pair of overlapping plates are spaced inwardly of the elongated intermediate sections of the at least one inside pair of conductors. One of the overlapping plates in the pair thereof is connected by a conductor tab to each of the elongated intermediate sections of at least one inside pair of conductors. A layer of non-conductive material is disposed between the overlapping plates. In the preferred embodiment, a plurality of the pairs of overlapping plates are provided.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
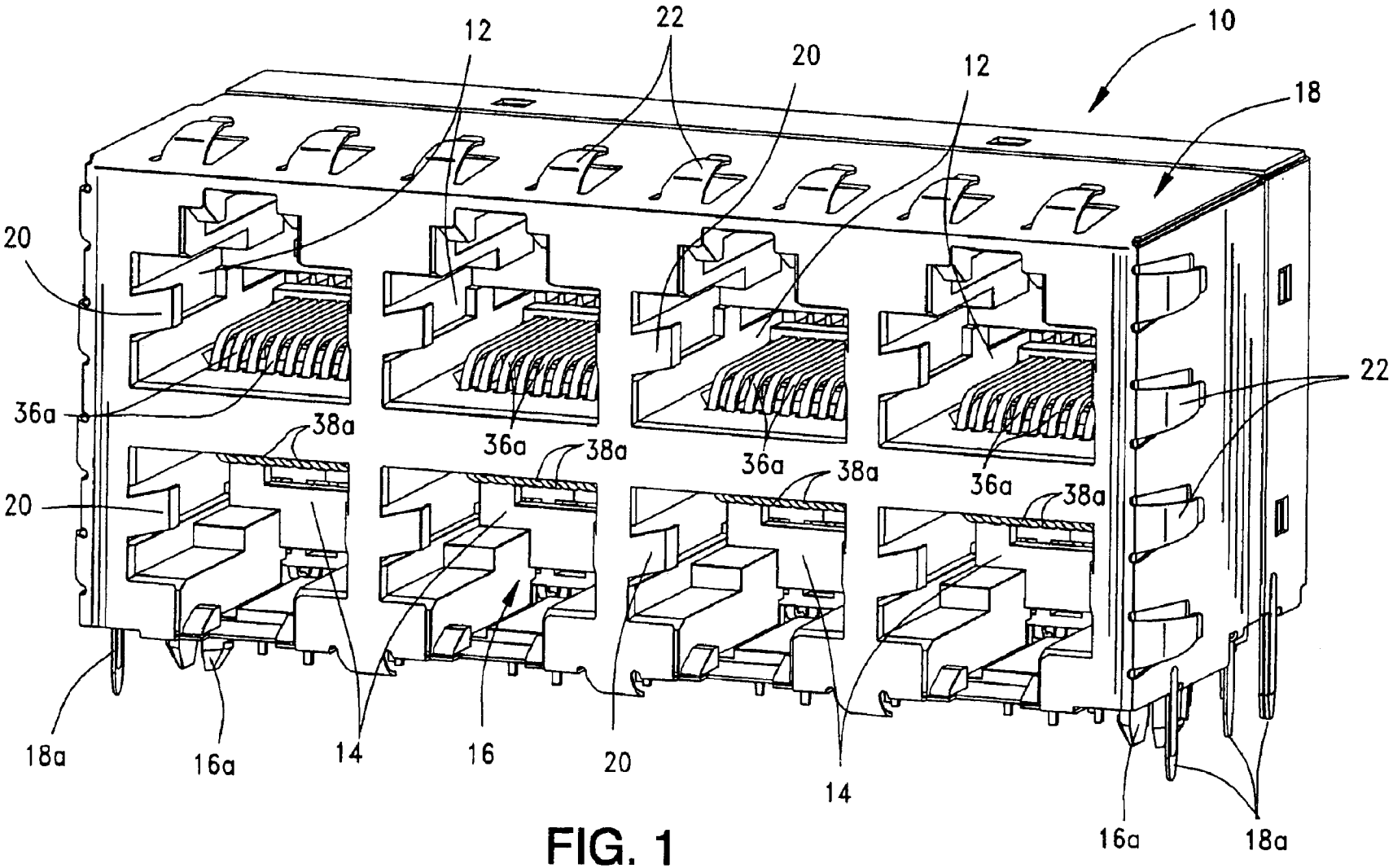
FIG. 1 is a front perspective view of a multi-port jack connector embodying the concepts of the invention.

Referring to the drawings in greater detail, and first to FIG. 1, the invention is shown herein as incorporated in a multi-port jack connector, generally designated 10, which includes a plurality of top ports or receptacles 12 and a plurality of bottom ports or receptacles 14. The top ports 12 are in a horizontal row above a horizontal row of the bottom ports 14. Each of the ports 12 and 14, in essence, form a modular jack for receiving a modular plug of a configuration well known in the art.

Connector 10 is of a generally conventional configuration to the extent that it includes a dielectric housing, generally designated 16, which is molded of plastic material. A conductive shell, generally designated 18, may be stamped and formed of sheet metal material and substantially surrounds the housing. The connector is designed for mounting on a printed circuit board. Therefore, housing 16 has a plurality of mounting posts 16*a* for insertion into appropriate mounting holes in the printed circuit board. Shell 18 has a plurality of posts or tails 18*a* for insertion into appropriate holes in the circuit board. The tails may be connected, as by soldering, to appropriate ground traces on the board and/or in the holes to ground the metal shell. The shell has integral spring fingers 20 projecting into ports 12 and 14 at opposite sides of each port for engaging metal shells or other grounding means of the mating modular plugs to also common the plugs to the ground traces on the circuit board. Finally, metal shell 18 has a plurality of integral spring fingers 22 projecting outwardly from the top and sides of the connector for engagement within an aperture or opening in a panel, support structure or the like, or in a second circuit board.

Ports or jacks 12 and 14 of multi-port jack connector 10 define four vertical pairs of ports in the embodiment shown in FIG. 1. In other words, there is a top port 12 and a bottom port 14 in each of the four vertical pairs of ports.

Figure 2:
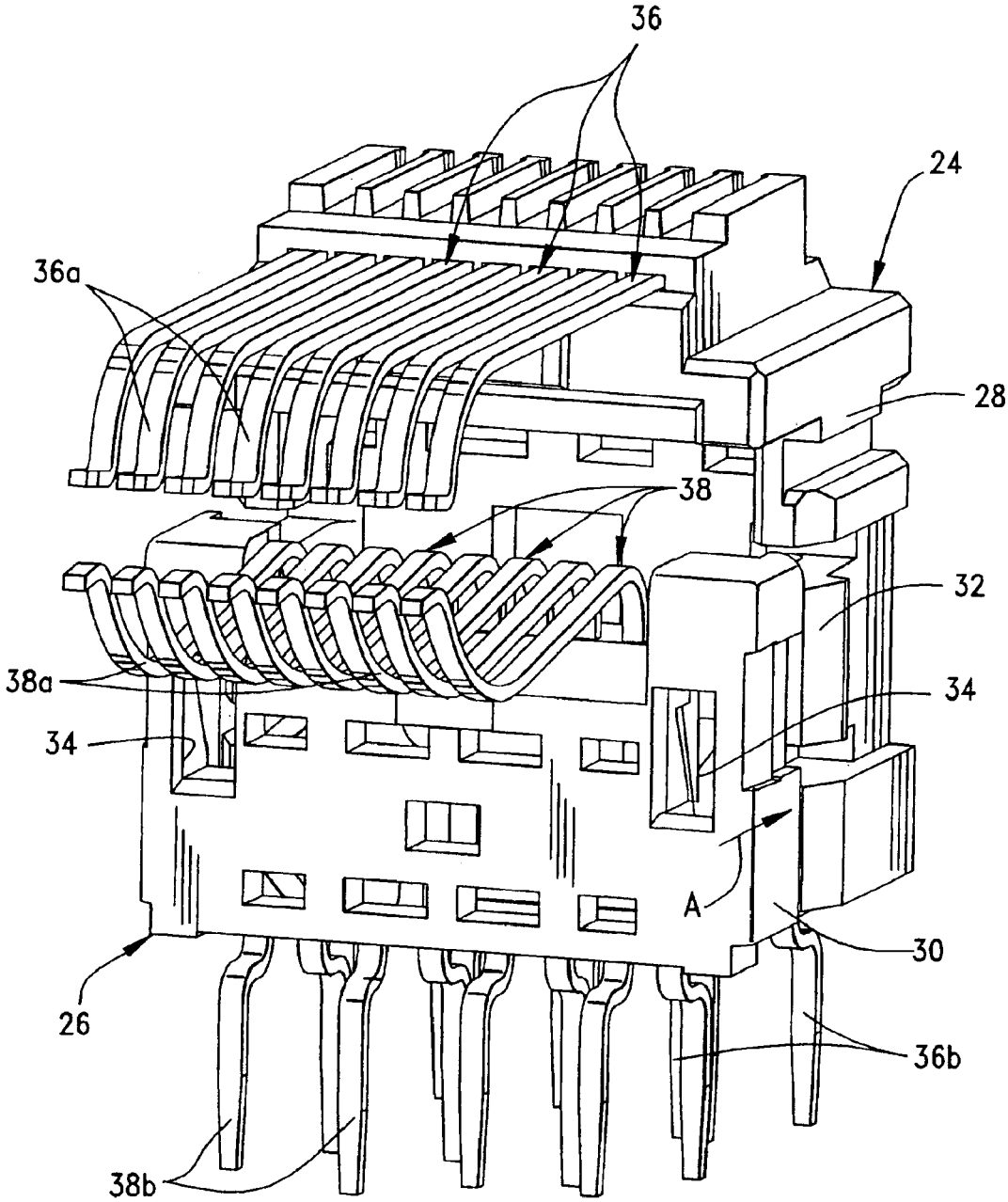
FIG. 2 is a perspective view of two terminal modules used in the multi-port jack connector.
Figure 3:
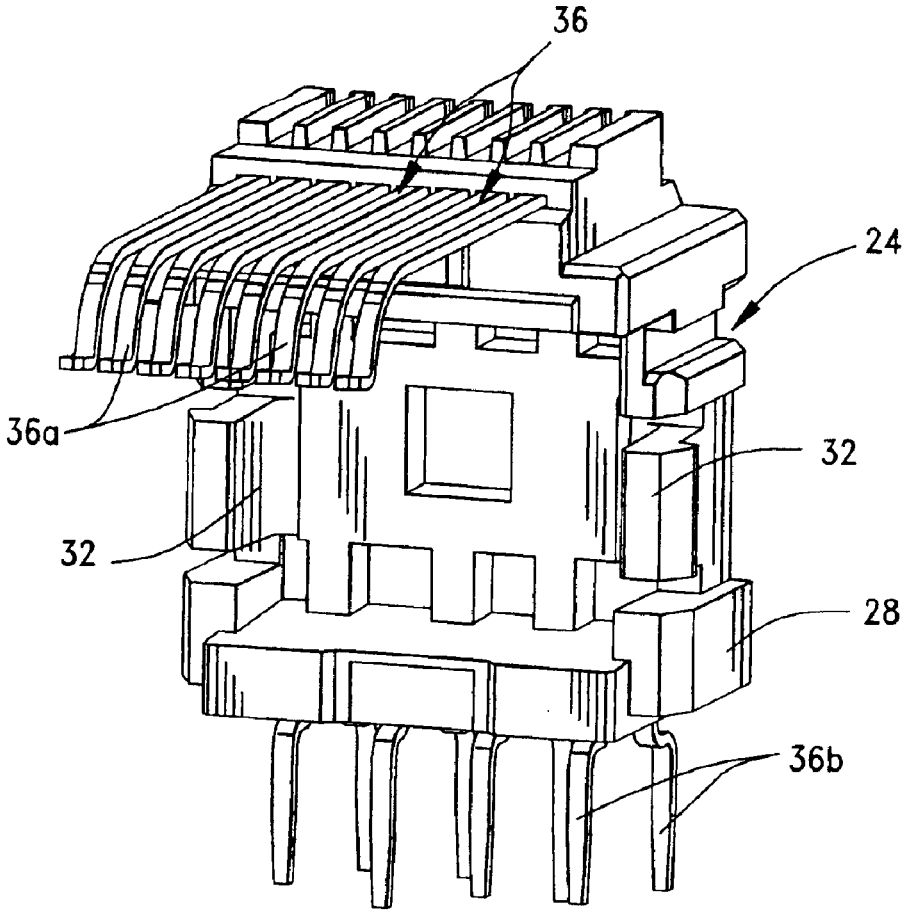
FIG. 3 is a perspective view of the top rear terminal module.
Figure 4:
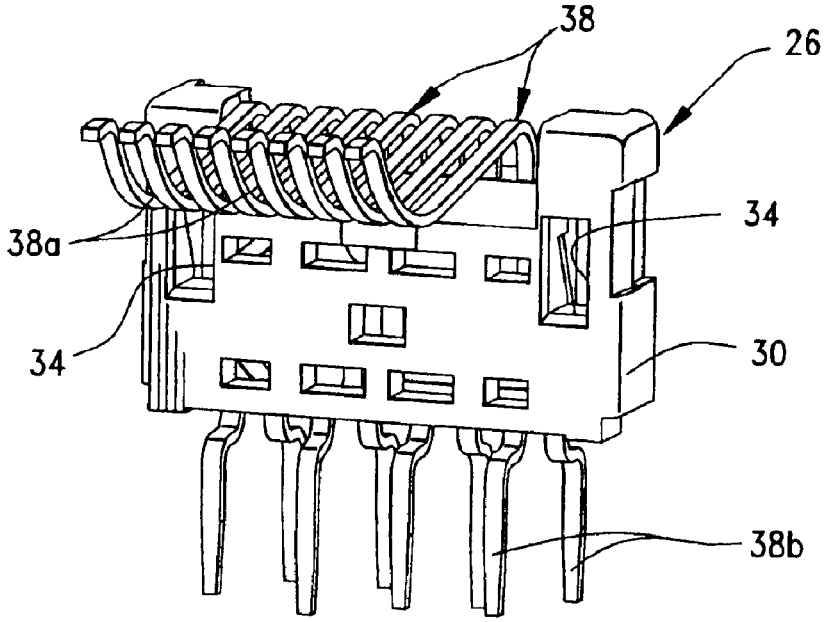
FIG. 4 is a perspective view of the bottom front terminal module.

With the above understanding, FIG. 2 shows a pair of nested terminal modules, generally designated 24 and 26, which are mounted at the rear of housing 16 and which are provided for each vertical pair of ports 12 and 14, respectively. FIG. 3 shows the top rear terminal module 24, and FIG. 4 shows the bottom front terminal module 26. Top rear terminal module 24 is associated with the respective top port 12 in the vertical pair of ports, and bottom front terminal module 26 is associated with bottom port 14 in the vertical pair thereof. It can be seen that rear terminal module 24 is taller than front terminal module 26.

More particularly, each terminal module 24 and 26 includes a one-piece molded plastic, dielectric housing 28 and 30, respectively. Front terminal module 26 is inserted into the rear of the dielectric housing 16 and is held in place with a pair of projections (not shown) extending rearwardly from the housing 16 which are cold staked into a pair of locking apertures 34 in housing 30 of the front terminal module 26. The rear terminal module 24 has a pair of locking arms 32 which project forwardly from the housing 28 into engagement with a pair of cooperating locking apertures (not shown).

Molded plastic housing 28 of top rear terminal module 24 is overmolded about a plurality of electrical terminals, generally designated 36. Each terminal 36 includes a contact end 36*a* and a terminating end 36*b*. Contact ends 36*a* of terminals 36 comprise spring contact arms which are cantilevered into top ports 12 as can be seen in FIG. 1 for engaging the contacts of the modular plugs inserted into the top ports. Terminating ends 36*b* of terminals 36 form solder tails which are inserted into appropriate holes in the printed circuit board for connection, as by soldering, to appropriate signal circuit traces on the printed circuit board and/or in the holes.

Molded plastic housing 30 of bottom front terminal module 26 is overmolded about a plurality of electrical terminals 38. Each terminal 38 includes a contact end 38*a* and a terminating end 38*b*. Contact ends 38*a* comprise spring contact arms which extend in a cantilevered fashion into one of the bottom ports 14 as seen in FIG. 1, and for engaging the contacts of the modular plug inserted into the bottom port. Terminating ends 38*b* of terminals 38 form solder tails for insertion into holes in the printed circuit board and for connection, as by soldering, to appropriate signal circuit traces on the board and/or in the holes.

It can be understood from the above that there is one pair of nested terminal modules as shown in FIG. 2 for each vertical pair of ports 12 and 14 of the multi-port jack connector 10 shown in FIG. 1. Therefore, there will be four nested pairs of terminal modules for the connector as illustrated. However, it should be understood that the invention is not limited to this particular configuration of a jack connector. In fact, the electrical signal transmission system of the invention is not limited to connectors, per se, and is equally applicable for a variety of applications where generally parallel or closely spaced conductors are employed, ranging from electrical connectors to the conductors of various circuit boards.

Figure 5:
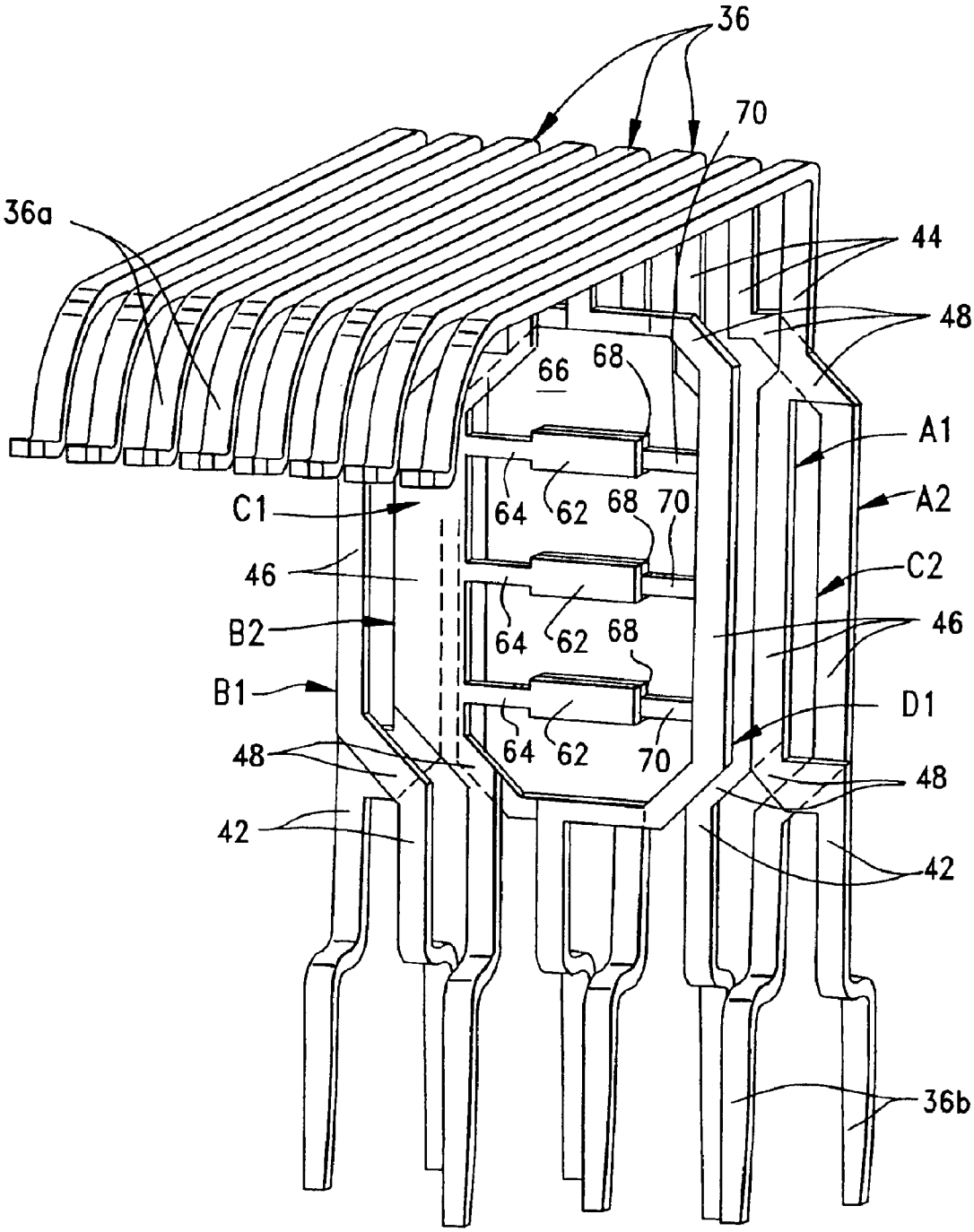
FIG. 5 is a perspective view of the array of terminals in the top rear terminal module of FIG. 3 and incorporating the electrical signal transmission system of the invention.
Figure 6:
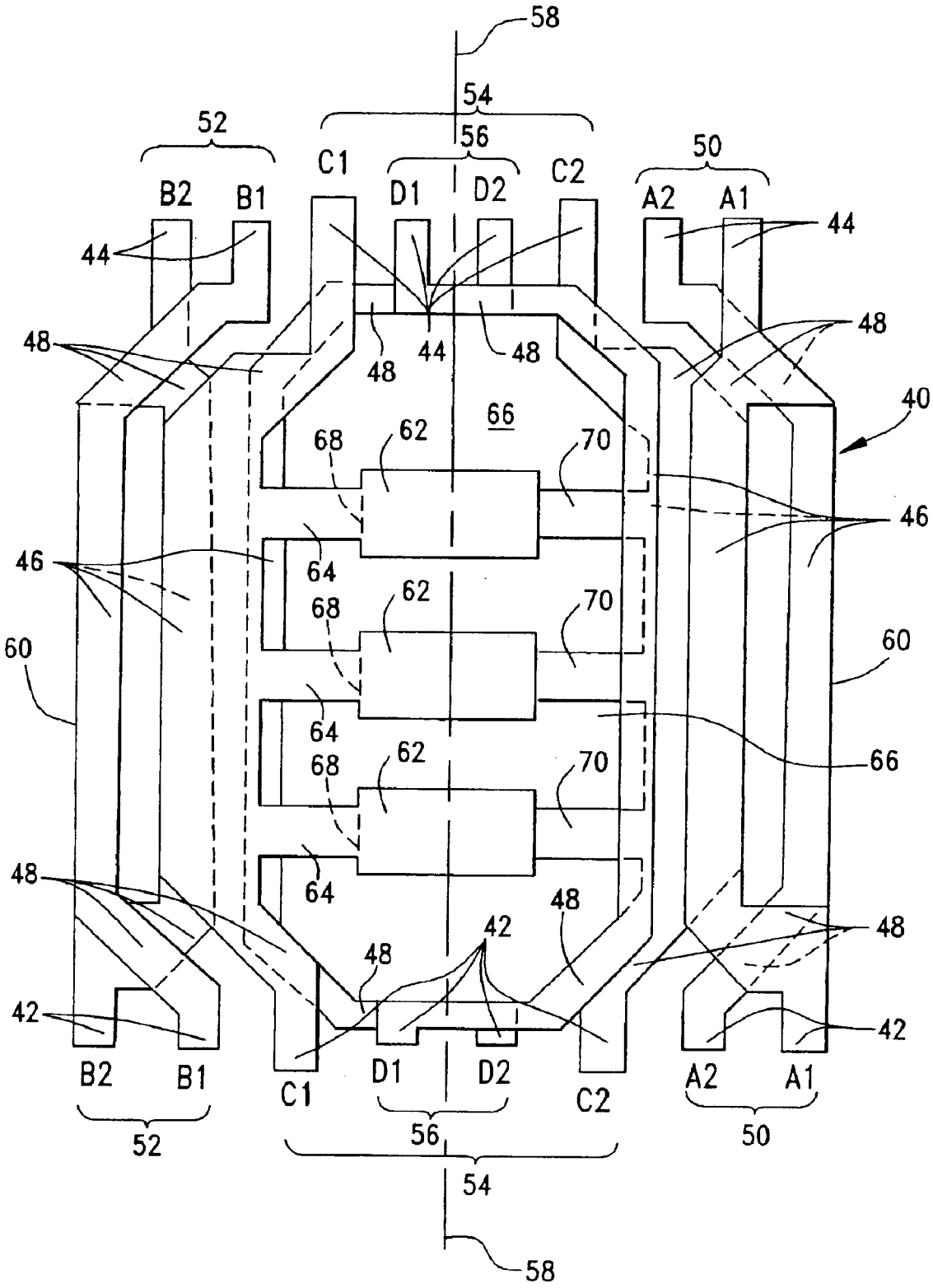
FIG. 6 is an enlarged elevation of the conductor array between the contact ends and the terminating ends of the terminals of FIG. 5.

FIG. 5 shows terminals 36 of one of the top rear terminal modules 24 (FIG. 3) with the overmolded plastic housing 28 removed to show the conductor array of the terminals between contact ends 36*a* and terminating ends 36*b* of the terminals. More particularly, FIG. 6 shows an enlargement of the conductor array for the terminals. FIGS. 5 and 6, in essence, show the electrical signal transmission system of the invention.

More particularly, FIG. 6 shows a generally parallel conductor array or electrical signal transmission system, generally designated 40 and includes a plurality (eight) of elongated conductors A1, A2, B1, B2, C1, C2, D1 and D2 extending in a generally parallel array. The conductors have input ends 42 at one end of the array and output ends 44 at the opposite end of the array. Input ends 42 are integral with terminating ends 36*b* of terminals 36 (FIG. 5) and are connected to the signal circuit traces on the printed circuit board. Output ends 44 are integral with contact ends 36*a* of terminals 36 which, in turn, are engageable with the contacts of the mating modular plug. Each conductor includes an elongated intermediate section 46 and transition sections 48 at opposite ends of the intermediate section joining the intermediate section to the input and output ends 42 and 44, respectively, of the conductor. Conductor array 40 defines two outside pairs 50 and 52 of conductors and two inside pairs 54 and 56 of conductors. Pair 50 includes conductors A1 and A2; pair 52 includes conductors B1 and B2; pair 54 includes conductors C1 and C2; and pair 56 includes conductors D1 and D2. In FIG. 6, conductor A1 is above conductor A2 in pair 50; conductor B1 is above conductor B2 in pair 52; conductor C1 is above conductor C2 in pair 54; and conductor D1 is above conductor D2 in pair 56. This generally parallel array of conductors 40 defines a center line 58 which is generally equidistant from and parallel to opposite sides 60 of the conductor array.

Going into further details of conductor array 40, transition sections 48 of conductors A1/A2 and B1/B2 in each outside pair 50 and 52 of the conductors cross each other. The elongated intermediate sections 46 of the conductors in each outside pair 50 and 52 thereof are spaced apart a distance generally equal to the spacing between the respective input ends 42 and the respective output ends 44 of the conductors in the respective outside pair 50 and 52 thereof. The elongated intermediate sections 46 of conductors C1/C2 and D1/D2 in each inside pair 54 and 56 are spaced apart wider than the elongated intermediate sections 46 of the conductors in each outside pair 50 and 52 thereof. The transition sections 48 of conductors D1 and D2 of inside pair 56 cross each other, while transition sections 48 of conductors C1 and C2 of inside pair 54 do not cross each other.

In reference to center line 58 of conductor array 40, elongated intermediate sections 46 of conductors A1 and A2 of outside pair 50 are spaced from the center line a distance equal to that of the elongated intermediate sections 46 of conductors B1 and B2 of outside pair 52. The intermediate sections 46 of conductors C1 and C2 of inside pair 54 are spaced equidistant from opposite sides of center line 58. Similarly, the elongated intermediate sections 46 of conductors D1 and D2 of inside pair 56 are spaced equidistant from opposite sides of center line 58.

Looking to the left-hand side of center line 58 of conductor array 40 in FIG. 6, elongated intermediate section 46 of inside conductor C1 overlaps the elongated intermediate section of outside conductor B2 and also overlaps portions of inside conductor D2. Looking to the right-hand side of center line 58 of conductor array 40 in FIG. 6, elongated intermediate section 46 of outside conductor A1 overlaps the elongated intermediate section of inside conductor C2. All of these overlapping portions of the conductors, as well as any other overlapping areas, such as at transition sections 48, between the top conductors and the bottom conductors may be separated by a layer of non-conductive material. For instance, the layer may be cut to conform to the shape of the conductors and adhered to the bottom sides of the overlapping top conductors.

A feature of conductor array 40 is to provide a capacitive coupling between conductors C1 and C2 of inside pair 54 thereof. Specifically, three plates 62 are connected by conductor tabs 64 to elongated intermediate section 46 of conductor C1 of inside pair 54. Therefore, the plates extend inwardly within an open area 66 of the conductor array. Similarly, three plates 68 are connected by conductor tabs 70 to elongated intermediate section 46 of conductor C2 of inside pair 54. Plates 62 of conductor C1 overlap plates 68 of conductor C2 to provide a capacitive coupling. Preferably, a layer of non-conductive material is disposed between the overlapping plates.

Conductor array 40, as described in detail above, provides a significantly improved electrical signal transmission system and significantly cancels the pair-to-pair interference or crosstalk created between the generally parallel pairs of conductors. For instance, there is significantly more crosstalk created in the middle of a circuit array, such as conductor array 40, than at the outside of the array. Therefore, it can be seen that the elongated intermediate sections 46 of the conductors C1/C2 and D1/D2 of inside pairs 54 and 56, respectively, are separated a significantly greater distance than the elongated intermediate sections of the outside pairs 50 and 52 of conductors A1/A2 and B1/B2, respectively, which will increase inductive coupling.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical signal transmission system, comprising:

a plurality of elongated conductors extending in a generally parallel array, the conductors having input ends at one end of the array and output ends at an opposite end of the array;

each conductor including an elongated intermediate section and transition sections at opposite ends of the intermediate section joining the intermediate section to said input and output ends of the conductor;

said array of conductors defining two outside pairs of conductors and at least one inside pair of conductors, the transition sections of the conductors in each outside pair of conductors crossing each other;

the elongated intermediate sections of the conductors in said inside pair thereof being spaced apart wider than the elongated intermediate sections of the conductors in each outside pair thereof; and the transition sections of the conductors in said at least one inside pair thereof cross each other.

2. The electrical signal transmission system of claim 1 wherein the elongated intermediate sections of the conductors in each outside pair thereof are spaced apart a distance generally equal the spacing between the respective input ends of the conductors in the respective outside pair thereof.

3. The electrical signal transmission system of claim 1 wherein said generally parallel array of conductors define a center line generally equidistant from and parallel to opposite sides of the array, and the elongated intermediate sections of the conductors in one outside pair thereof are spaced from the center line a distance equal to that of the elongated intermediate sections of the conductors in the other outside pair thereof.

4. The electrical signal transmission system of claim 1 wherein said generally parallel array of conductors define a center line generally equidistant from and parallel to opposite sides of the array, and the elongated intermediate sections of the conductors in said at least one inside pair thereof are spaced equidistant from opposite sides of the center line.

5. The electrical signal transmission system of claim 4 wherein the elongated intermediate sections of the conductors in one outside pair thereof are spaced from the center line a distance equal to that of the elongated intermediate sections of the conductors in the other outside pair thereof.

6. The electrical signal transmission system of claim 1, including a second inside pair of conductors having elongated intermediate sections spaced apart wider than the elongated intermediate sections of the conductors in each outside pair thereof.

7. The electrical signal transmission system of claim 6 wherein the transition sections of the conductors in said second inside pair thereof are separated from each other and are void of any crossover.

8. The electrical signal transmission system of claim 1 wherein an elongated intermediate section of a conductor of at least one of said pairs of conductors substantially overlaps an elongated intermediate section of a conductor of at least another of the pairs of conductors.

9. The electrical signal transmission system of claim 8, including a layer of non-conductive material disposed between the overlapping elongated intermediate sections.

10. The electrical signal transmission system of claim 1, including a pair of overlapping plates spaced inwardly of the elongated intermediate sections of said at least one inside pair of conductors, one of the overlapping plates in said pair thereof being connected by a conductor tab to each of the elongated intermediate sections of the at least one inside pair of conductors.

11. The electrical signal transmission system of claim 10, including a layer of non-conductive material disposed between said overlapping plates.

12. The electrical signal transmission system of claim 10, including a plurality of said pairs of overlapping plates spaced inwardly of the elongated intermediate sections of said at least one inside pair of conductors, one of the overlapping plates in each pair thereof being connected by a conductor tab to each of the elongated intermediate sections of the at least one inside pair of conductors.

13. An electrical signal transmission system, comprising:

a plurality of elongated conductors extending in a generally parallel array and defining a center line generally equidistant from and parallel to opposites sides of the array, the conductors having input ends at one end of the array and output ends at an opposite end of the array;

each conductor including an elongated intermediate section and transition sections at opposite ends of the intermediate section joining the intermediate section to said input and output ends of the conductor;

said array of conductors defining two outside pairs of conductors and at least one inside pair of conductors, the transition sections of the conductors in each outside pair of conductors crossing each other;

the elongated intermediate sections of the conductors in said inside pair thereof being spaced apart wider than the elongated intermediate sections of the conductors in each outside pair thereof;

the elongated intermediate sections of the conductors in each outside pair thereof being spaced apart a distance generally equal the spacing between the respective input ends of the conductors in the respective outside pair thereof;

the elongated intermediate sections of the conductors in one outside pair thereof being spaced from the center line a distance equal to that of the elongated intermediate sections of the conductors in the other outside pair thereof;

the elongated intermediate sections of the conductors in said at least one inside pair thereof being spaced equidistant from opposite sides of the center line; and a second inside pair of conductors having elongated intermediate sections spaced apart wider than the elongated intermediate sections of the conductors in each outside pair thereof.

14. The electrical signal transmission system of claim 13 wherein the transition sections of the conductors in said at least one inside pair thereof cross each other.

15. The electrical signal transmission system of claim 14 wherein the transition sections of the conductors in said second inside pair thereof are separated from each other and are void of any crossover.

16. The electrical signal transmission system of claim 13 wherein an elongated intermediate section of a conductor of at least one of said pairs of conductors substantially overlaps an elongated intermediate section of a conductor of at least another of the pairs of conductors.

17. The electrical signal transmission system of claim 16, including a layer of non-conductive material disposed between the overlapping elongated intermediate sections.

18. The electrical signal transmission system of claim 13, including a pair of overlapping plates spaced inwardly of the elongated intermediate sections of said at least one inside pair of conductors, one of the overlapping plates in said pair thereof being connected by a conductor tab to each of the elongated intermediate sections of the at least one inside pair of conductors.

19. The electrical signal transmission system of claim 18, including a layer of non-conductive material disposed between said overlapping plates.

20. The electrical signal transmission system of claim 18, including a plurality of said pairs of overlapping plates spaced inwardly of the elongated intermediate sections of said at least one inside pair of conductors, one of the overlapping plates in each pair thereof being connected by a conductor tab to each of the elongated intermediate sections of the at least one inside pair of conductors.

21. An electrical signal transmission system, comprising:

a plurality of elongated conductors extending in a generally parallel array, the conductors having input ends at one end of the array and output ends at an opposite end of the array;

each conductor including an elongated intermediate section and transition sections at opposite ends of the intermediate section joining the intermediate section to said input and output ends of the conductor;

said array of conductors defining two outside pairs of conductors and at least one inside pair of conductors, the transition sections of the conductors in each outside pair of conductors crossing each other; and the elongated intermediate sections of the conductors in said inside pair thereof being spaced apart a distance at least three times wider than the distance the elongated intermediate sections of the conductors in each outside pair thereof are spaced apart.

22. An electrical signal transmission system, comprising:

a plurality of elongated conductors extending in a generally parallel array, the conductors having input ends at one end of the array and output ends at an opposite end of the array;

each conductor including an elongated intermediate section and transition sections at opposite ends of the intermediate section joining the intermediate section to said input and output ends of the conductor;

said array of conductors defining two outside pairs of conductors and at least one inside pair of conductors, the transition sections of the conductors in each outside pair of conductors crossing each other; and the elongated intermediate sections of the conductors in said inside pair thereof being spaced apart a distance greater than the spacing between the input ends of the conductors in said inside pair thereof.

23. An electrical signal transmission system, comprising:

a plurality of elongated conductors extending in a generally parallel array and defining a center line generally equidistant from and parallel to opposites sides of the array, the conductors having input ends at one end of the array and output ends at an opposite end of the array;

each conductor including an elongated intermediate section and transition sections at opposite ends of the intermediate section joining the intermediate section to said input and output ends of the conductor;

said array of conductors defining two outside pairs of conductors and at least one inside pair of conductors, the transition sections of the conductors in each outside pair of conductors crossing each other;

the elongated intermediate sections of the conductors in each outside pair thereof being spaced apart a distance generally equal the spacing between the respective input ends of the conductors in the respective outside pair thereof;

the elongated intermediate sections of the conductors in said inside pair thereof being spaced apart a distance at least three times wider than the distance the elongated intermediate sections of the conductors in each outside pair thereof are spaced apart;

the elongated intermediate sections of the conductors in one outside pair thereof being spaced from the center line a distance equal to that of the elongated intermediate sections of the conductors in the other outside pair thereof; and the elongated intermediate sections of the conductors in said at least one inside pair thereof being spaced equidistant from opposite sides of the center line.

24. An electrical signal transmission system, comprising:

a plurality of elongated conductors extending in a generally parallel array and defining a center line generally equidistant from and parallel to opposites sides of the array, the conductors having input ends at one end of the array and output ends at an opposite end of the array;

each conductor including an elongated intermediate section and transition sections at opposite ends of the intermediate section joining the intermediate section to said input and output ends of the conductor;

said array of conductors defining two outside pairs of conductors and at least one inside pair of conductors, the transition sections of the conductors in each outside pair of conductors crossing each other;

the elongated intermediate sections of the conductors in said inside pair thereof being spaced apart wider than the elongated intermediate sections of the conductors in each outside pair thereof and spaced apart a distance greater than the spacing between the input ends of the conductors in said inside pair thereof;

the elongated intermediate sections of the conductors in each outside pair thereof being spaced apart a distance generally equal the spacing between the respective input ends of the conductors in the respective outside pair thereof;

the elongated intermediate sections of the conductors in one outside pair thereof being spaced from the center line a distance equal to that of the elongated intermediate sections of the conductors in the other outside pair thereof; and the elongated intermediate sections of the conductors in said at least one inside pair thereof being spaced equidistant from opposite sides of the center line.

* * * * *